US005094561A

United States Patent [19]

Polnarava

[11] Patent Number: 5,094,561

[45] Date of Patent: Mar. 10, 1992

[54] COMPRESSING ASSEMBLY FOR A SUPPORTING DEVICE

[76] Inventor: Arnoldo G. Polnarava, David Raziel 424/18, Jerusalem, Israel

[21] Appl. No.: 592,463

[22] Filed: Oct. 1, 1990

Related U.S. Application Data

[63] Continuation-in-part of Ser. No. 407,557, Sep. 15, 1989, abandoned.

[30] Foreign Application Priority Data

Sep. 18, 1988 [IL] Israel ..... 87786

[51] Int. Cl.[5] ..... F16B 7/08

[52] U.S. Cl. ..... 403/168; 248/200.1; 248/205.5; 211/105.4

[58] Field of Search ..... 403/167, 168; 248/200.1, 205.5, 206.3; 211/105.4

[56] References Cited

U.S. PATENT DOCUMENTS

| | | | |
|---|---|---|---|
| 1,256,849 | 2/1918 | Vaudreuil | 248/200.1 X |
| 1,356,454 | 10/1920 | Knight | 211/105.4 |
| 1,700,544 | 1/1929 | Ruka et al. | 248/206.3 |
| 2,903,227 | 9/1959 | Key | 248/200.1 |
| 3,040,902 | 6/1962 | Dunn | 211/105.4 |

FOREIGN PATENT DOCUMENTS

| | | | |
|---|---|---|---|
| 661682 | 11/1951 | United Kingdom | 248/200.1 |

*Primary Examiner*—Andrew V. Kundrat

[57] ABSTRACT

The invention provides a tensioning assembly for a supporting device securable by axial expansion between substantially parallel surfaces, comprising an elastomeric body provided with a major face for contact with one of the surfaces and an opposite face provided with an aperture extending partially towards the major face, a tensioning screw member of diameter complementary to the aperture and having a first end configured for insertion therein, the member being provided with an intermediate enlarged platform rigidly attached thereto at an axial location removed from both extremities thereof, the tensioning screw member being provided with a male screw thread at its opposite end, the depth of the aperture being substantially equal to the length of the first end of the tensioning screw member whereby, upon assembly, an upper surface of the flange transmits an axial force to the opposite face of the elastomeric body, and a cap member configured for attachment to a strut beam and provided with a female screw thread configured for the insertion therein of the male screw thread and for the transmission of axial thrust to the strut beam.

10 Claims, 1 Drawing Sheet

COMPRESSING ASSEMBLY FOR A SUPPORTING DEVICE

This is a continuation-in-part of application Ser. No. 07/407,557 filed on Sept. 15, 1989 and now abandoned.

The present invention relates to improvements in supporting device preferably for indoor use. More particularly, it is concerned with providing an improved compressing assembly for a supporting device which may be used horizontally or vertically as a furniture item having a wide range of uses including high dynamic load applications such as support for a children's swing or even for an exercise bar.

A supporting device for indoor use should meet the following requirements:

a. To be length adjustable.

b. To be easily installable and removable by an unskilled person.

c. To avoid marring a ceiling when installed in contact therewith.

d. To be adaptable to a wide range of uses.

e. To provide sufficient strength for its intended application.

Supports or struts which may be readily located between two bearing surfaces are known in the art for decades.

However, none of the presently known removable struts is adapted to ensure to an adequate extent all of the above characteristics. In particular, various weaknesses of known designs inhibit their use for dynamic applications such as hammock suspension and as support for a children's swing and for supports subject to severe transversal forces.

Thus, e.g. British Patent 661,682 describes and claims a support adapted to be located between two bearing surfaces and to support removable parts such as panels and partitions, comprising a column provided at one end with a first member adapted to be applied to one of said bearing surfaces and having secured therein at the other end an internally-threaded part engaged by a hollow screw projecting longitudinally from said columm and carrying through a guided spring a second member adapted to bear against the second of said bearing surfaces, whereby on rotation of said screw said members are brought to bear on the bearing surfaces and yielding pressure is constantly exerted on said surfaces.

Similarly, U.S. Pat. No. 2,903,227 describes and claims a display supporting fixture which relies on a spring tensioned telescoping arrangement.

As will be realized, while the force of a spring loaded column, as taught in said two prior art patents might be adequate for moderate static loads, the limited force of a compression spring cannot be relied upon to resist substantial dynamic loads without severe vibration.

Furthermore, the introduction of a spring-loaded system involves extra mechanical parts which increases the cost of the assembly on the one hand and the chances for mechanical failure on the other.

SUMMARY OF THE INVENTION

It is therefore one of the objects of the present invention to obviate the disadvantages of the prior-art removable struts and to provide a compressing assembly for a supporting device which meets all of the listed requirements and in particular to resist substantial dynamic loads.

This the present invention achieves by providing a compressing assembly for a supporting device securable by axial expansion between substantially parallel surfaces, comprising:

an elastomeric body provided with a major face for contact with one of said surfaces and an opposite face provided with an aperture extending partially towards said major face; and a screw member having a first part of outer dimensions complementary to the inner dimensions of said aperture and thereby configured for insertion therein, a second part provided with threads forming a male screw thread and an intermediate enlarged platform attached thereto at an axial location removed from both extremities thereof and provided with a bearing surface surrounding and facing said first part, whereby, upon assembly, said bearing surface at least indirectly contacts and transmits an axial force to said opposite face of said elastomeric body.

In preferred embodiments of the present invention the area of said major face of said elastomeric body is greater than the area of said opposite face, whereby said elastomeric body is shaped to distribute a compressive force over a wider area for greater security and stability and thus the elastomeric body is preferably shaped as a truncated pyramid or truncated cone. As will be realized, said elastomeric body can be made of any suitable material having elastic properties which also improves the friction adherence of the body to the surface against which it is pressed.

In especially preferred embodiments of the present invention there is further provided a washer having an aperture similar in size to that in said elastomeric body to enable the insertion of said first part of said screw member therethrough, which washer is insertable between said opposite face of said elastomeric body and said platform, whereby axial force from said platform is transmitted to said opposite face via said washer. Preferably the outer diameter of said washer is substantially similar to the diagonal of the opposite face of said elastomeric body to more effectively transfer the upwards pressure in a homogeneous way. Said preferred washer also prevents deterioration of the elastomeric material by protecting it from friction erosion while the screw member is being rotated and also serves to facilitate the screwing action.

In U.S. Pat. No. 1,256,849 there is described and claimed a clothes hanger support, wherein the tensioning assembly therein bears superficial resemblance to the tensioning assembly of the present invention in that said assembly achieves transmission of axial thrust by the interaction of male and female screw threads.

The assembly of said patent, however, differs both physically and functionally from the assembly of the present invention.

The screw member of the present invention resembles a thick bolt without a head, englarged near one of its extremities with an intermediate enlarged platform which resembles a nut welded to the bolt and preferably forming an integral unit therewith. Thus said screw member can be visualized as having a t-shaped cross-section along its longitudinal axis wherein the upper surface of the arms of the t is sized to transmit axial force either directly or via a washer to substantially the entire opposite face of the elastomeric body.

In contradistinction thereto in the assembly described and claimed in U.S. Pat. No. 1,256,846, the screw is described therein as a threaded bolt with a headed end and can be visualized as having the cross-section of a capital T wherein only the headed end of the threaded bolt of said arrangement bears against the recess provided in the inner end of the rigid cylindrical body which is pressed against the closet wall surface, which arrangement does not provide for the distribution of forces enabled by the novel structure of the present invention as herein defined.

In the present invention axial force is transmitted from the bearing surface of the platform to the opposite face of the elastomeric body and increases in tensioning pressure result in a tighter adhering by the elastomeric surfaces of the aperture surrounding the first part of the screw member inserted therein.

In contradistinction thereto the support of U.S. Pat. No. 1,256,849 all of the axial force upon tensioning of the screw is transmitted to the top surface of the aperture thereby eroding and possibly even damaging the same.

Thus, e.g. in a similar arrangement of a threaded bolt as seen in U.S. Pat. No. 2,903,227 excess tensioning could even result in the head of the threaded bolt puncturing the thin walled rubber suction cup used therein.

Thus in contradistinction to the teachings of the prior art, the insertion of the first part of the screw member into the aperture is not to transmit axial force thereto and instead is to transmit the radial components of forces applied thereto.

While in British Patent 661682 there is described an elastomeric body, this body is not provided with an aperture which allows transmission of radial force components as in the present assembly and thus said Patent is also based on different principles of energy, dispersion and absorption.

Thus, in the assembly of said British Patent, tranversal forces are not adequately dealt with and sheer separation of the elastomeric body and the surface against which it is pressed or between the plate pressing against the elastomeric body and said body, can readily occur.

It will therefore be realized that neither of said Patents alone or in combination teach or suggest the novel and advantageous assembly of the present invention which assembly transmits axial forces to a bottom surface of an elastomeric body while simultaneously transmitting radial force components to the inner surfaces of an aperture provided in said elastomeric body.

In another embodiment of the present invention said elastomeric body is composed of two different materials, said major face being made of an elastomeric material and said opposite face being made of a non-elastomeric material, or of a material of different elastomeric properties, however, also in this embodiment the bearing surface of the screw member applies axial force to said opposite face and in fact acts as a stop preventing the end of said first part from contacting and eroding the roof of said aperture.

The platform in traverse cross-section may be of any shape since its primary function is to provide an enlarged abutment surface for transmitting axial force to the elastomeric body, however, it is preferably of polygonal cross-section to facilitate the use of a wrench, spanner or pliers thereon to forcefully rotate the same.

Especially preferred is a platform of regular polygonal cross section such as hexagonal or square cross-section.

Said platform may also be further provided with a throughgoing transverse hole of a diameter to allow the insertion of a turning tool therein.

Thus said screw member is preferably provided with a hole running diametrically across and through it. The purpose of this hole is to enable a thin bar, screwdriver or strong long nail to be inserted therein to facilitate the rotation thereof to effect the tensioning of the assembly.

In U.S. Pat. No. 1,256,849, it is to be noted also that a hole is used as the sole means for adjusting the strut length, thereby seriously weakening the supporting screw, at an area where the screw needs maximum strength since all the dynamic forces applied to said unit pass through said area. In fact the torque forces of tightening the unit also are applied specifically to the screw through said hole and therefore at the weakest point thereof. Furthermore as will be realized in the embodiment of said patent, the bolt head is inaccessible for torque application by the user.

Thus it will be realized that in preferred embodiments of the present invention, there is provided an elastomeric body which is shaped to distribute a compressive force over a wide area. The screw member is provided with an intermediate enlarged platform which is accessible to the user, is easily gripped by a tool and may be further provided with a transverse hole for rotating by a tool or a nail which may be inserted into the large platform diameter, thereby retaining the full strength of the cylindrical screwed element. The washer provided between the platform and the elastomeric element eases the task of rotating the screw element and further serves to spread the compression load over a wide area of the elastomeric body.

The strut may be used horizontally or vertically.

The assembly of the present invention is intended to produce a pre-compressing power on pole or beam elements working under conditions of presso-flexion as they are being mounted in the desired place with the possibility of mounting and taking apart in a quick and easy way without causing any damage to or leaving any marks on the surfaces to which they are applied.

The struts, poles or beams can be of iron, steel, wood or any other material suitable for the purpose although hollow metallic strut beams are preferred.

It will be realized that the compressing assembly of the present invention can also be used to secure structural plates by axial expansion between substantially parallel surfaces when said plates are provided with openings containing a female screw thread configured for the insertion therein of the male screw thread of the screw members of the present invention. Therefore, the term supporting device as used herein is intended to include such structural elements which can be viewed as having been formed with this feature incorporated therein.

A supporting device constructed according to the present invention and which is securable by axial expansion between parallel surfaces is basically composed of four principle parts as defined herein, namely the elastomeric body designed for contact with one of said surfaces, a strut element or structural unit having the equivalent of a strut being incorporated therein and designed for contact with the opposed surface, the screw member and a threaded cap member which attaches to the top of said strut element and receives the male screw thread of said screw member.

As indicated, the threaded cap member has a female screw thread strong enough for its function and complementary to the matching male screw thread provided d at the opposite end of said tensioning screw member. The connection of the cap member to the strut element can be permanent, e.g., by welding or temporary with the possibility of dismountable mounting, e.g., with a socket and plug arrangement as seen hereinafter with reference to the figures.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 shows a longitudinal cross-sectional view partially fragmented of a preferred embodiment of the strut according to the invention as in use;

FIG. 2 is an exploded perpsective view of the same embodiment; and

FIG. 3 is a cross-sectional view of a second embodiment of the elastomeric body.

DESCRIPTION OF THE PREFERRED EMBODIMENT

Figure 1:
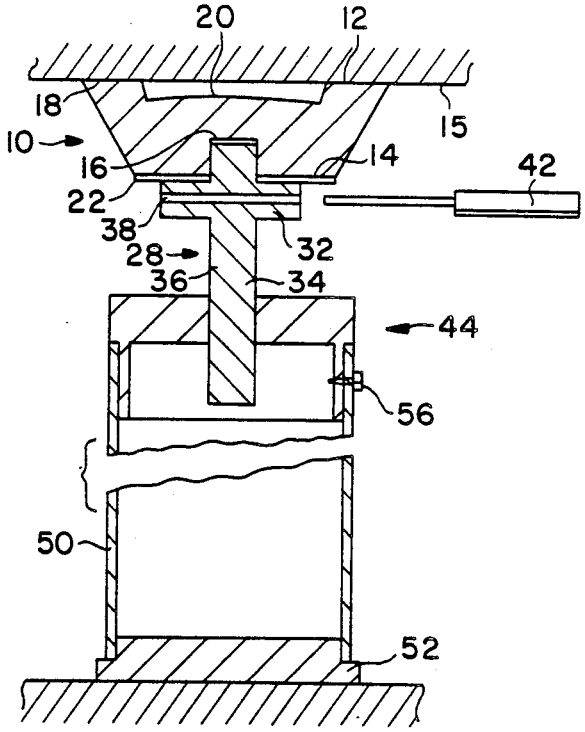
Figure 2:
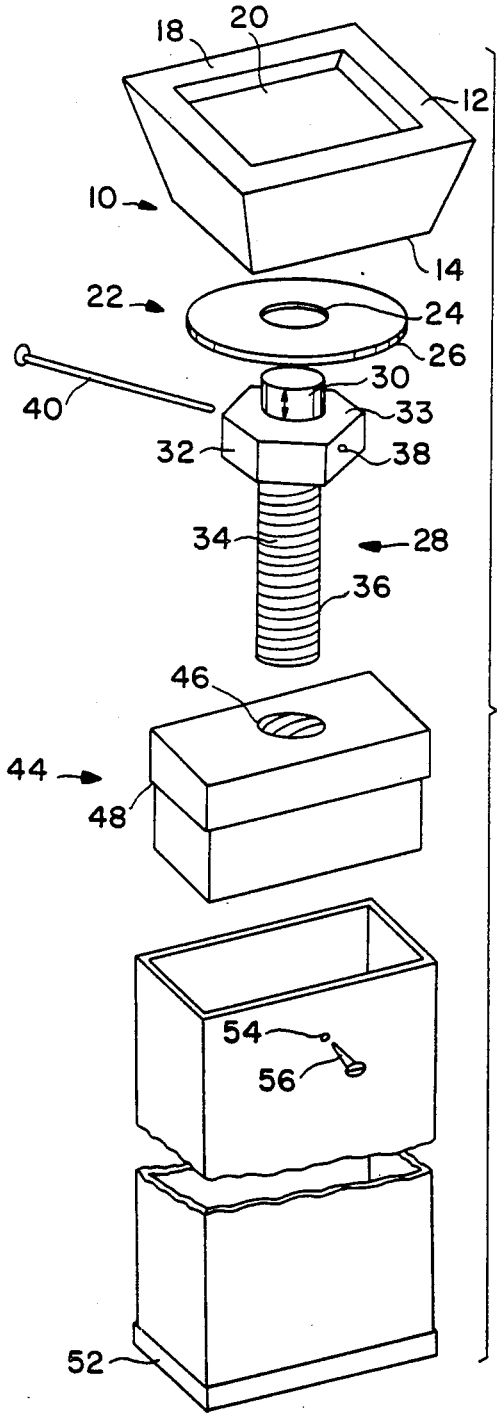

There is seen in FIGS. 1 and 2 an elastomeric body 10 of general truncated pyrimidal shape provided with a major face 12 and an opposite face 14. The major face 12 is configured to contact a wall or ceiling surface 15 and this embodiment is preferably divided into an outer rim 18 and a hollowed section 20. An aperture 16 extends from the opposite face 14 partially into the body of the body. As the body is compressed in use, a partial vacuum is formed in the hollowed section 20, which provides additional gripping power. A suitable material for the elastomeric body 10 is a strong rubber.

For use in the assembly of the present invention there is provided a screw member 28 having a) a first part 30 whose length and diameter are complementary to the aperture 16 into which it is inserted when the strut is in use;

b) an intermediate enlarged platform 32 provided with an upper bearing surface 33 which is of non-circular cross-section such as hexagonal; and c) a second part 34 of substantial length provided with a male screw thread 36.

Figure 3:
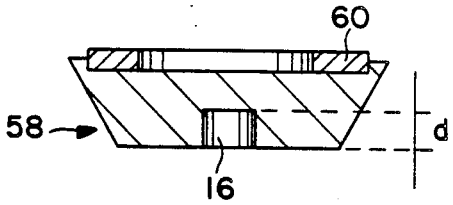

The height or depth d of aperture 16, as better seen in FIG. 3, is substantially equal to the height or length L of said first part 30 of said screw member 28 whereby, when assembled, the upper surface 33 of said platform 32 transmits an axial force to the opposite face 14 and part 30 transmits the transverse forces to the lateral faces of aperture 16 of said elastomeric body 10.

The assembly can work in combination with a cap member 44 configured for attachment to strut beam 50 and provided with a female screw thread 46 configured for the insertion therein of matching male screw thread 36 and for the transmission of axial thrust to a strut element 50.

As shown, said first part 30 of said screw member 28 is preferably surrounded by with a washer 22 having an aperture diameter 24 similar in size to aperture 16 in said elastomeric body and insertable between said opposite face 14 of said elastomeric body and the upper face 33 of said platform, whereby axial force from said platform is transmitted to said opposite face 14 via said washer 22.

The outer diameter 26 of the washer 22 is preferably similar in size to the diagonal of the opposite face 14 with which it is in contact when the strut is assembled. The washer 22 is rigid, and preferably made of a metal.

The platform 32 is preferably provided with a transverse hole 38 configured to allow the insertion of a nail 40 or of a turning tool 42.

Cap member 44 is preferably provided with a shoulder 48 to facilitate the transmission of a compressive force to strut element 50 to which the cap member 44 is assembled.

The strut element 50 is preferably made of a hollow steel pole provided with a high friction foot pad 52. The strut beam 50 is configured to allow the convenient attachment of items such as shelving, light fixtures, work tables, exercise bars, blackboards, display screens, a room divided, children's swing or hammock.

Optionally the strut beam is provided with a small aperture 54 to allow the insertion of a fastener 56 to secure the cap member 44.

FIG. 3, shows an elastomeric body 58 wherein a major face 60 is made of an elastomeric material such as rubber, the remainder of the body being made of a non-elastomeric material such as a metal. This combination provides increased strength while meeting the requirement for non-marring contact with a wall or ceiling surface.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A compressing assembly for a supporting device securable by axial expansion between substantially parallel force resistant surfaces, comprising:

an elastomeric body provided with a major face for contact with one of said surfaces and an opposite face provided with an aperture extending partially towards said major face;

a screw member having a first part of outer dimensions substantially complementary to the inner dimensions of said aperture and thereby configured for insertion therein, a second part provided with threads forming a male screw thread and an intermediate enlarged platform fixedly attached thereto at an axial location removed from both extremities thereof and provided with a bearing surface surrounding and facing said first part, whereby, upon assembly, said bearing surface at least indirectly contacts and transmits an axial force to said opposite face of said elastomeric body over a substantial surface area thereof; and a cap member configured for attachment to a strut element and provided with a female screw thread configured for the insertion therein of said male screw thread and for the transmission of axial thrust to said strut element.

2. A compressing assembly for a supporting device as claimed in claim 1, further comprising a washer member having an outer diameter substantially the size of said opposite face of said elastomeric body and having an aperture similar in size to that in said elastomeric body to enable the insertion of said first end of said first part of said screw member therethrough and insertable between said opposite face of said elastomeric body and said intermediate enlarged platform, whereby axial force from said platform is transmitted to substantially the entire surface area of said opposite face via said washer.

3. A compressing assembly for a supporting device as claimed in claim 1, wherein the area of said major face of said elastomeric body is greater than the area of said opposite face.

4. A compressing assembly for a supporting device as claimed in claim 1, wherein said elastomeric body is composed of two different materials, said major face being made of an elastomeric material and said opposite face being made of a non-elastomeric material.

5. A compressing assembly for a supporting device as claimed in claim 1, wherein said platform is of polygonal cross-section.

6. A compressing assembly for a supporting device as claimed in claim 1, wherein said platform is further provided with a transverse bore of a diameter to allow the insertion of a turning tool.

7. A compressing assembly for a supporting device as claimed in claim 1, wherein said first part is cylindrical in shape.

8. A tensioning assembly for a supporting device as claimed in claim 1, wherein said major face of said elastomeric body is hollowed so as to leave a rim for contact with one of said surfaces.

9. A compressing assembly for a supporting device as claimed in claim 1, wherein said cap member is provided with a shoulder arranged to engage walls of said strut element and to transmit a compressive force thereto.

10. A supporting device securable by axial expansion between substantially parallel force resistant surfaces, comprising:

an elastomeric body provided with a major face for contact with one of said surfaces and an opposite face provided with an aperture extending partially towards said major face;

said major face defining a central recess facing said one of said surfaces so as to leave a rim for contact with said surface;

a screw member having a first part of outer dimensions substantially complementary to the inner dimensions of said aperture and thereby configured for insertion therein, a second part provided with threads forming a male screw thread and an intermediate enlarged platform fixedly attached thereto at an axial location removed from both extremities thereof and provided with a bearing surface surrounding and facing said first part, whereby, upon assembly, said bearing surface at least indirectly contacts and transmits an axial force to said opposite face of said elastomeric body over a substantial surface area thereof;

a hollow strut element; and a cap member configured for attachment to said strut element and provided with a female screw thread configured for the insertion therein of said male screw thread and for the transmission of axial thrust to said strut element, said cap member being provided with a shoulder arranged to engage walls of said strut element and to transmit a compressive force thereto.

* * * * *